US012778356B2

(12) United States Patent
Sakharwade et al.

(10) Patent No.: US 12,778,356 B2
(45) Date of Patent: Nov. 3, 2026

(54) HAND AND FOOT WASHING DEVICE

(71) Applicants: Praveen Sakharwade, Nagpur (IN); Kanishk Walondre, Nagpur (IN)

(72) Inventors: Praveen Sakharwade, Nagpur (IN); Kanishk Walondre, Nagpur (IN)

( * ) Notice: Subject to any disclaimer, the term of this patent is extended or adjusted under 35 U.S.C. 154(b) by 357 days.

(21) Appl. No.: 18/570,160

(22) PCT Filed: Jun. 17, 2022

(86) PCT No.: PCT/IN2022/050555
§ 371 (c)(1),
(2) Date: Dec. 14, 2023

(87) PCT Pub. No.: WO2022/264173
PCT Pub. Date: Dec. 22, 2022

(65) Prior Publication Data

US 2025/0127343 A1 Apr. 24, 2025

(30) Foreign Application Priority Data

Jun. 17, 2021 (IN) ..... 202121011381

(51) Int. Cl.

| | |
|---|---|
| ***A47K 7/04*** | (2006.01) |
| ***A46B 5/06*** | (2006.01) |
| ***A46B 13/04*** | (2006.01) |
| ***A46B 15/00*** | (2006.01) |
| ***E03C 1/14*** | (2006.01) |

(52) U.S. Cl.
CPC ..... *A47K 7/04* (2013.01); *A46B 5/06* (2013.01); *A46B 13/04* (2013.01); *A46B 15/0008* (2013.01); *E03C 1/14* (2013.01); *A46B 2200/1006* (2013.01)

(58) Field of Classification Search
CPC .. A47K 7/04; A46B 5/06; A46B 13/04; A46B 15/0008; A46B 2200/1006; E03C 1/14
See application file for complete search history.

(56) References Cited

U.S. PATENT DOCUMENTS

2018/0282984 A1* 10/2018 Reeder ..... E03D 9/04

FOREIGN PATENT DOCUMENTS

| | | | | | |
|---|---|---|---|---|---|
| CN | 104523421 | A | * | 4/2015 | ..... A47K 7/04 |
| CN | 104758165 | A | * | 7/2015 | ..... A61H 39/04 |
| CN | 111543883 | A | * | 8/2020 | ..... A47K 7/04 |
| CN | 110248580 | B | * | 4/2022 | ..... A47K 7/04 |
| GB | 2500201 | A | * | 9/2013 | ..... A61H 33/6021 |
| KR | 20040104906 | A | * | 12/2004 | |
| KR | 20080031534 | A | * | 4/2008 | ..... A47K 1/02 |
| KR | 102180296 | B1 | * | 11/2020 | ..... A47K 7/026 |
| KR | 200494094 | Y1 | * | 8/2021 | ..... A47K 7/026 |
| WO | WO-2004109021 | A1 | * | 12/2004 | ..... E03C 1/01 |

* cited by examiner

*Primary Examiner* — Marc Carlson
(74) *Attorney, Agent, or Firm* — Intellectual Property Consulting, LLC; Jared Rovira

(57) ABSTRACT

A hand and foot washing device (100) is described. The hand and foot washing device (100) includes a hand washing unit (104), a connector (108), feet washing unit (112) and a control unit (400). The hand washing unit (104) further includes a washbasin (312), a nozzle (308). The feet washing unit (112) includes a first base (204) and a second base (208). The first base (204) is placed above the second base (212). The first spray 216 includes plurality of nozzles that directs the spray inwards towards the pair of protective mesh (220).

9 Claims, 6 Drawing Sheets

HAND AND FOOT WASHING DEVICE

FIELD OF THE INVENTION

The present invention relates to a washing appliance and more particularly to a device for washing hand and foot.

BACKGROUND OF THE INVENTION

Maintaining good hygiene and cleanliness is one of the best ways to stay healthy. Personal hygiene not only benefits one's personal health but also impacts the people around that person. Maintaining personal as well as public cleanliness prevents spread of various diseases and infections. The importance of good hygiene and cleanliness is now even more apparent due to the pandemic. It is well known that washing hands and feet regularly is a very primitive yet effective and important form of hygiene.

Washing hands and feet before entering homes, workspaces, religious places like temples, swimming pools, etc. was a very common practice and custom especially in Asian households to maintain hygiene and cleanliness. However, due to the recent trend of living in building complexes, apartments and studio apartments that is in smaller houses especially in cities this practice of washing hands and feet regularly before entering is nowadays lost and ignored. Recently due to the pandemic, the extreme importance of maintaining hygiene and cleanliness has become very apparent.

Currently, water taps and basins are provided outside larger homes and temples to facilitate washing of hands and feet before entering. However, the drawback of washing hands and feet under the current water taps and basins is that the taps and basins require a lot of space and cannot be installed outside smaller offices and homes. Another drawback of this type of taps and basins is the used water is left to run off in the open that causes wastage of water, soil pollution and in some cases become breeding grounds of mosquitoes.

German Patent DE29701860U1 discloses a portable bathroom module. The invention discloses a bathroom module with wash-basin located in a showering room along with a lavatory. The drawback of this type of invention is that module requires a considerable amount of space and cannot be installed outside an apartment in a building complex. Another drawback of this type of invention is that the module does not provided automatic cleaning of foot especially on the rear side of the feet.

There is a need of a device for cleaning hand and feet that is portable and installable outside small apartments. There is further need of a device for cleaning hands and feet that detects and automatically cleans the feet and hands of a user.

SUMMARY OF THE INVENTION

A hand and foot washing device having a screen display, a first water storage, a second water storage, and a main water storage. A hand washing unit for cleaning user's hand, a connector connecting the hand washing unit with a feet washing unit and a control unit configured to operate the hand washing unit and the feet washing unit. The hand washing unit including a nozzle dispensing fluid and a basin collecting the dispensed water.

The feet washing unit including a first base, a second base; the first base including a first sprayer. The second base including a pair of protective mesh receiving user's feet. The feet washing unit including a first inlet, a second inlet, a third inlet, a pair of belt brushes, a pair of motor, a drive belt and a pair of chain drive. The control unit being configured for operating the pair of motors, scrubbing the pair of belt brushes and dispensing the water, soap and air from the nozzle and the first spray respectively. A weighing scale including a weight sensor positioned below the pair of protective mesh for detecting the presence of human feet and activating the control unit.

A pipe connector receiving water from the first storage tank and draining the waste water to the second storage tank. The connector encapsulating pipes for inletting and out letting the water from the first storage tank and the second storage tank respectively. The motion sensor sensing the hand movement below the nozzle. The first sprayer including nozzles for dispensing fluid on the user's feet. The pair of chain drive being fixedly connected to the pair of motor. The drive belt being fixedly attached with the chain drive. The pair of belt brushes being fixedly position on the drive belt. The pair of motor driving the chain drive, the drive belt and the pair of belt brushes.

BRIEF DESCRIPTION OF THE DRAWINGS

The objectives and advantages of the present invention will become apparent from the following description read in accordance with the accompanying drawings wherein.

DETAILED DESCRIPTION OF THE INVENTION

The invention described herein is explained using specific exemplary details for better understanding. However, the invention disclosed can be worked on by a person skilled in the art without the use of these specific details.

References in the specification to "one embodiment" or "an embodiment" means that particular feature, structure, characteristic, or function described in connection with the embodiment is included in at least one embodiment of the invention. The appearances of the phrase "in one embodiment" in various places in the specification are not necessarily all referring to the same embodiment.

References in the specification to "preferred embodiment" means that a particular feature, structure, characteristic, or function described in detail thereby omitting known constructions and functions for clear description of the present invention.

The foregoing description of specific embodiments of the present invention has been presented for purposes of illustration and description. They are not intended to be exhaustive or to limit the present invention to the precise forms disclosed, and obviously many modifications and variations are possible in light of the above teaching.

Figure 1:
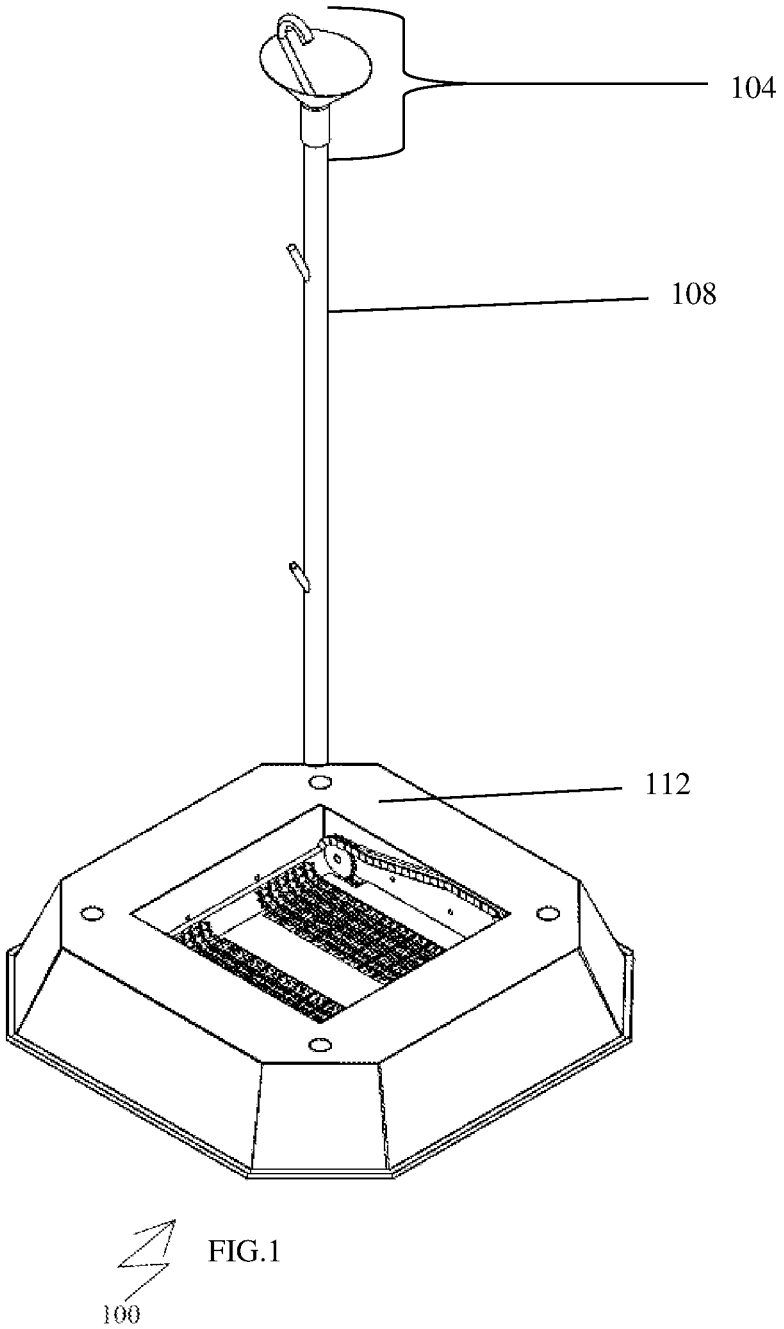
FIG. 1 shows a front perspective view of the hand and foot washing device in accordance with a preferred embodiment of the present invention.

Referring to FIG. 1, a hand and foot washing device 100 in accordance with a preferred embodiment of the present is described. The hand and foot washing device 100 (hereby referred to as "device") includes a hand washing unit 104, a connector 108, a feet washing unit 112 and a control unit (not seen). The hand washing unit 104 further includes a washbasin, a water dispenser, and a soap dispenser.

Figure 2:
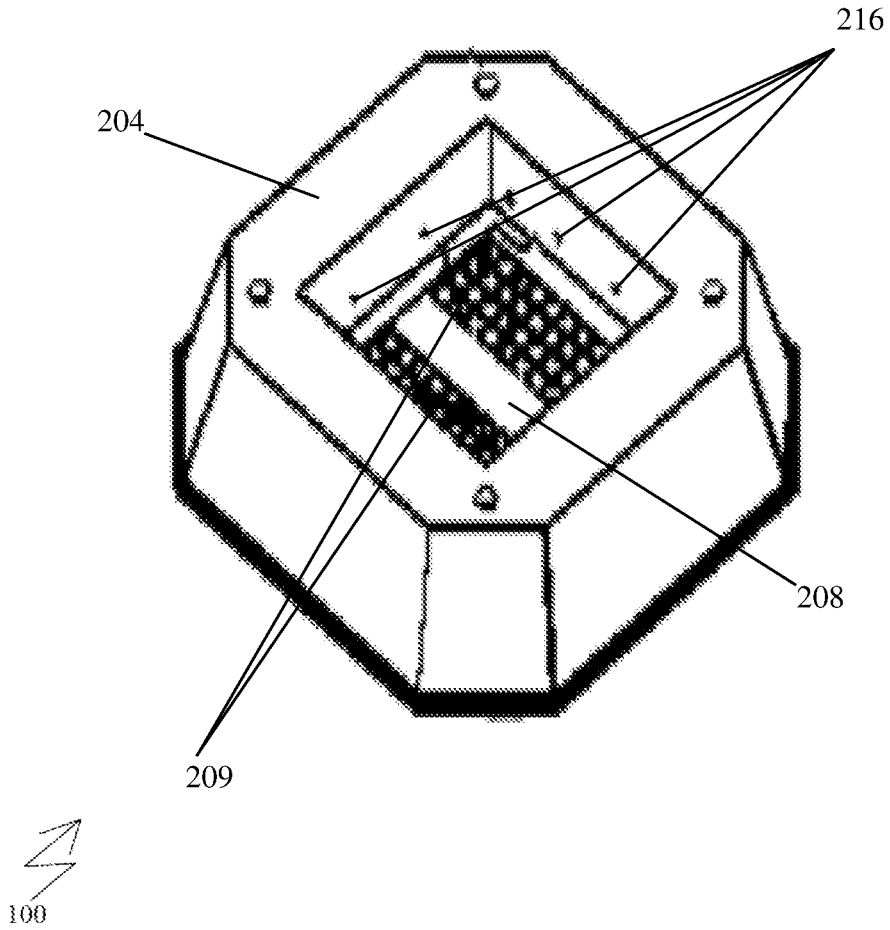
FIG. 2 shows a top perspective view of the hand and foot washing device of FIG. 1.
Figure 2A:
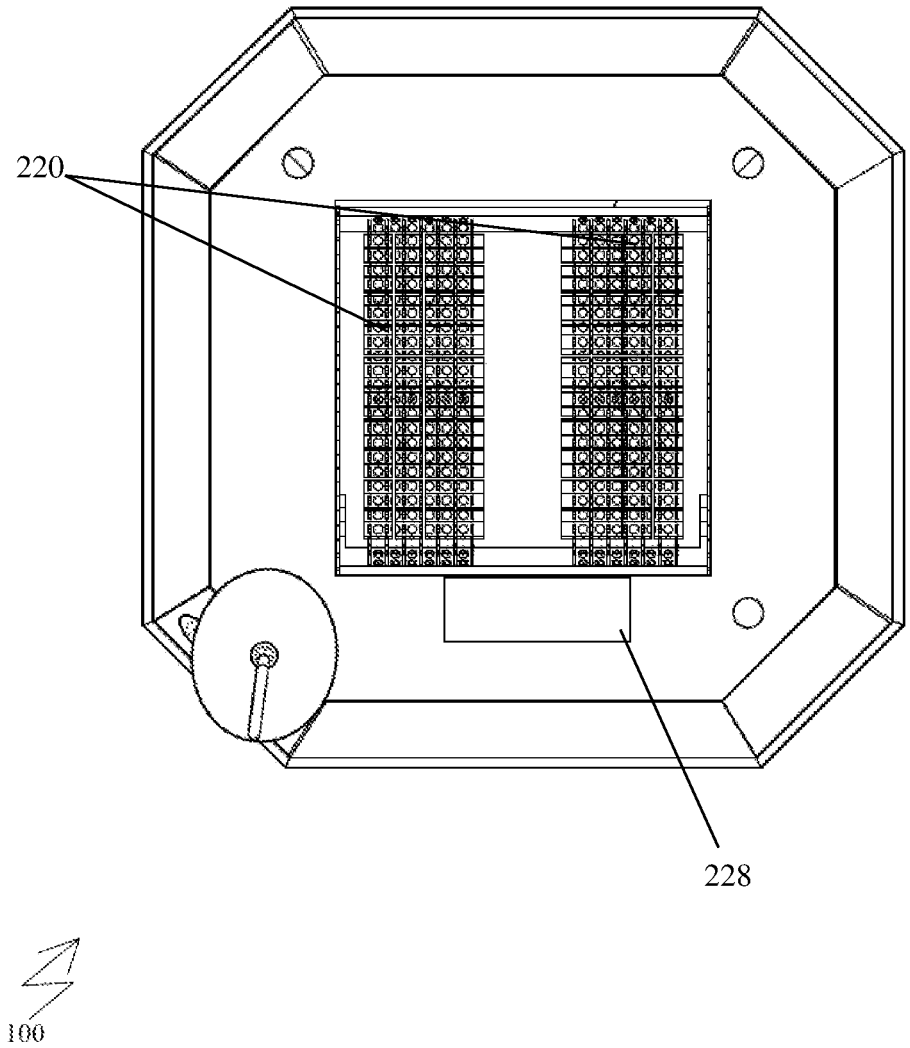
FIG. 2A shows a top view of the hand and foot washing device of FIG. 1.

Now referring to FIGS. 2-2A the feet washing unit 112 is described. The feet washing unit 112 includes a first base 204, a second base 208, a pair of protective mesh 209, a pair of conveyor belt brush 220 and a screen display 228. The first base 204 is placed above the second base 208. The first base 204 includes a first spray 216. The first spray 216 includes plurality of nozzles that are positioned inside the first base 208. The first spray 216 inwardly directs the spray preferably of water or air towards the pair of protective mesh 209.

The protective mesh 209 is positioned on the second base 208. The protective mesh 209 has the shape and size of a human feet. For example in this one embodiment the size of the protective mesh 209 is 2 ft×2 ft. The protective mesh 209 is preferably made of materials such as aluminum, steel, plastic and the like in this particular embodiment however, the shape and size may vary in other embodiments of the present invention.

The pair of conveyor belt brush 220 is positioned below the protective mesh 209. The feet washing unit 112 includes plurality of indicators that are preferably LED indicators to indicate various conditions of the hand and foot washing device 100 for example, indicator beckoning conditions like low water in water storage, sensor malfunctioning, and the like. The first base 204 further includes a plurality of drain holes (not seen) to drain the waste water. The drain holes are preferably placed in equidistant fashion separating from each other. The drain holes are positioned under the pair of conveyor belt brush 220.

Figure 2B:
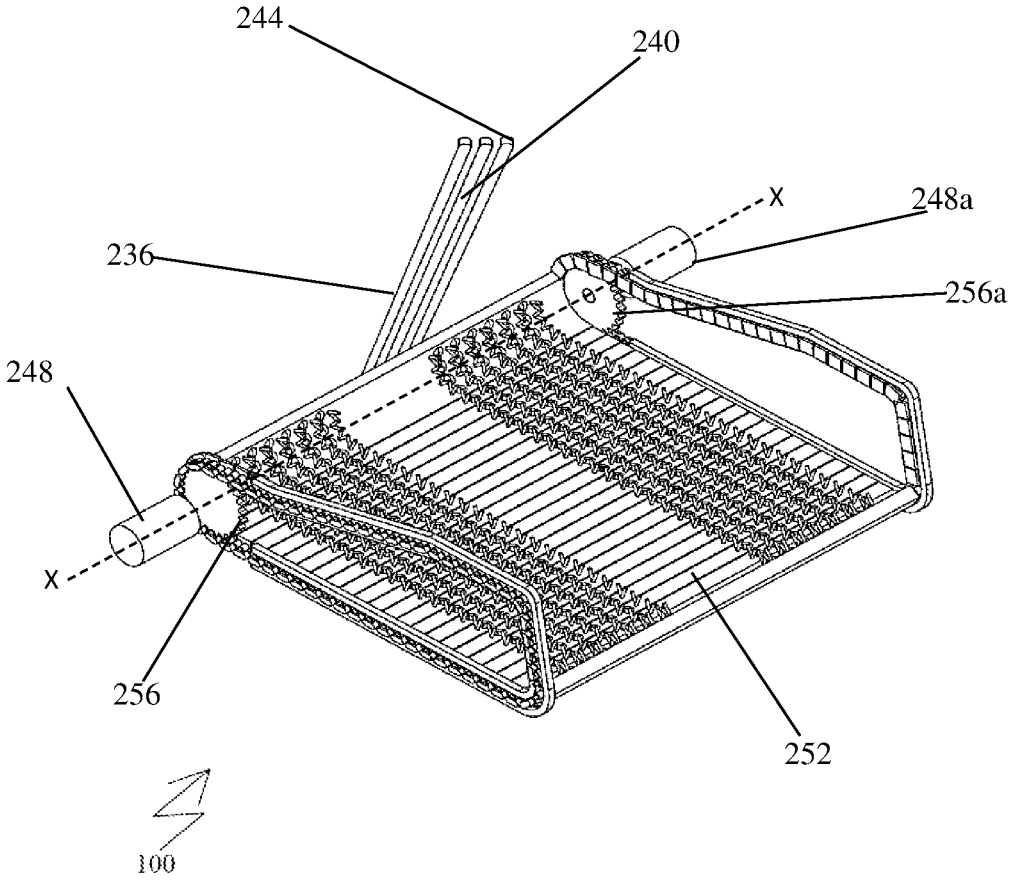
FIG. 2B shows a perspective view of the hand and foot washing device of FIG. 1.

Now referring to FIG. 2B, the feet washing unit 112 of the device 100 is described. The device 100 includes a first inlet 236, a second inlet 240, a third inlet 244, a pair of motors 248, 248*a*, a drive belt 252 and a pair of chain drive 256, 256*a*. The first inlet 236 is connected preferably to a water inlet. The second inlet 240 is preferably connected to an air inlet and the third inlet 244 is preferably connected to a soap inlet.

In accordance with the present invention, a plurality of spray holes (not seen) are positioned under the pair of conveyor belt brush 220. The spray holes are connected with the inlets 236, 240 and 244 to spray water, air and soap respectively. The inlets 236, 240 and 244 are connected with the storage tank from one end and with the spray holes from another end. The air inlet 240 is connected with the air compressor for out letting compressed air.

The pair of motor 248, 248*a* is connected with the pair of chain drive 256, 256*a*. The pair of motor 248, 248*a* drives the pair of chain drive 256, 256*a*. The drive belt 252 is fixedly attached with the chain drive 256, 256*a*. Further, the pair of belt brushes 220 is fixedly position on the drive belt 252. The pair of motors 248, 248*a* drives the chain drive 256, 256*a*, the drive belt 252 and the pair of belt brushes 220. The pair of belt brushes 220 are scrubbed against the bottom feet, the ankle and the mid foot region of the user.

Figure 3:
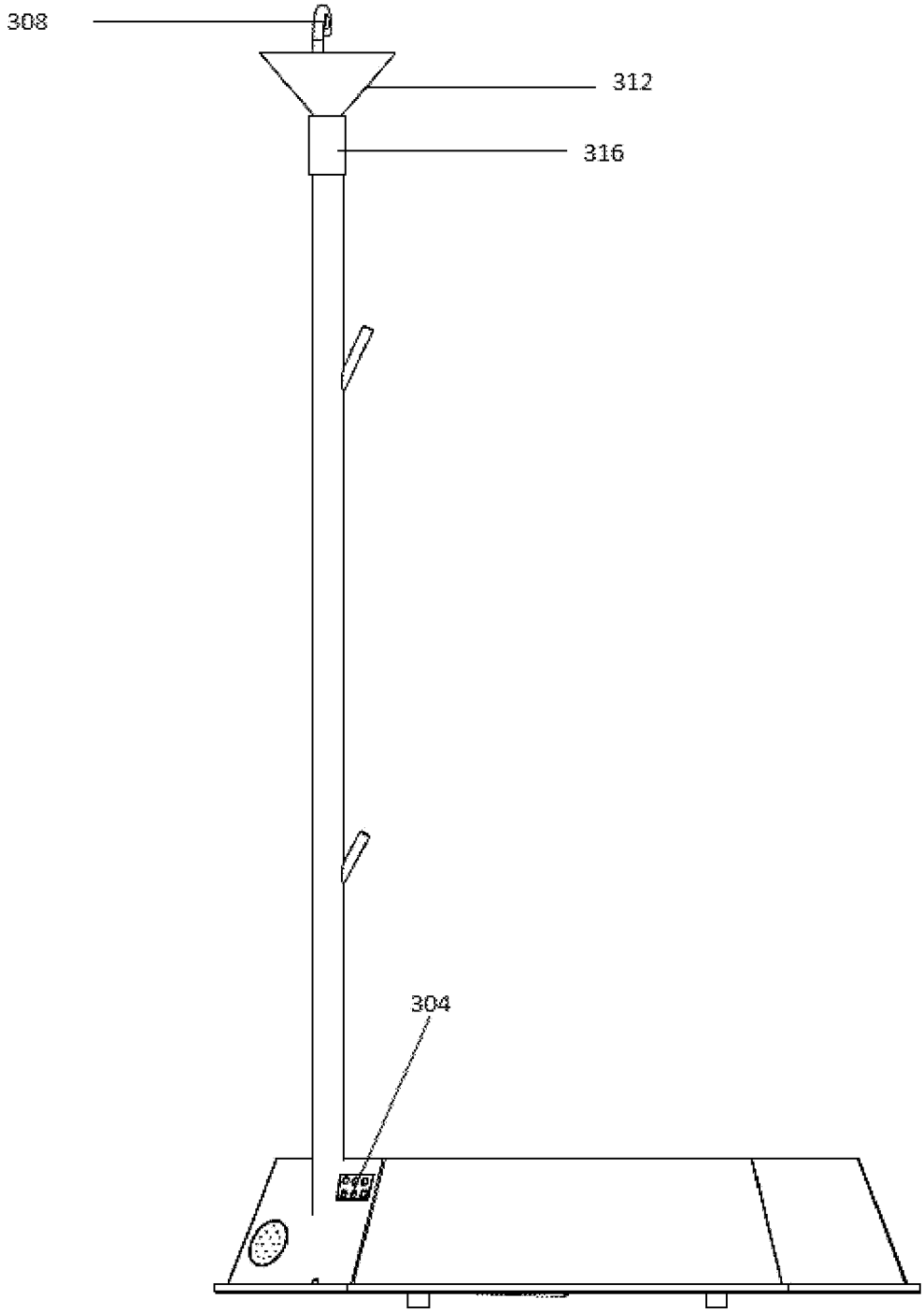
FIG. 3 shows a side view of the hand and foot washing device of FIG. 1.

Now referring to FIG. 3, the device 100 is further described. The hand washing unit 104 includes a socket 306, a nozzle 308, a basin 312 and a filter 316. The socket 306 receives electric terminal to power the device 100. The nozzle 308 dispenses soap or water or any other fluid. The nozzle 308 is placed just above the basin 312 of the hand washing unit 104. A sensor (not seen) preferably a motion sensor is placed on the base of the nozzle 308. The sensor is connected with the nozzle 308 for dispensing fluid. The filter 316 connects the basin 312 with the connector 108. In this present embodiment, the filter 316 is for example a mechanical filter, an ion exchange filter or a reverse osmosis filter or a combination of such filters however, the type of filter varies in other embodiments of the present invention. The filter 316 filters the solid waste received from the wash basin and outlets the drain water through the connecting pipe passed through the connector 108. The filter 316 is removable attachable between the basin 312 and the connector 108. The pipe connector 304 connects an inlet pipe for receiving water and the outlet pipe for draining the waste water.

Figure 4:
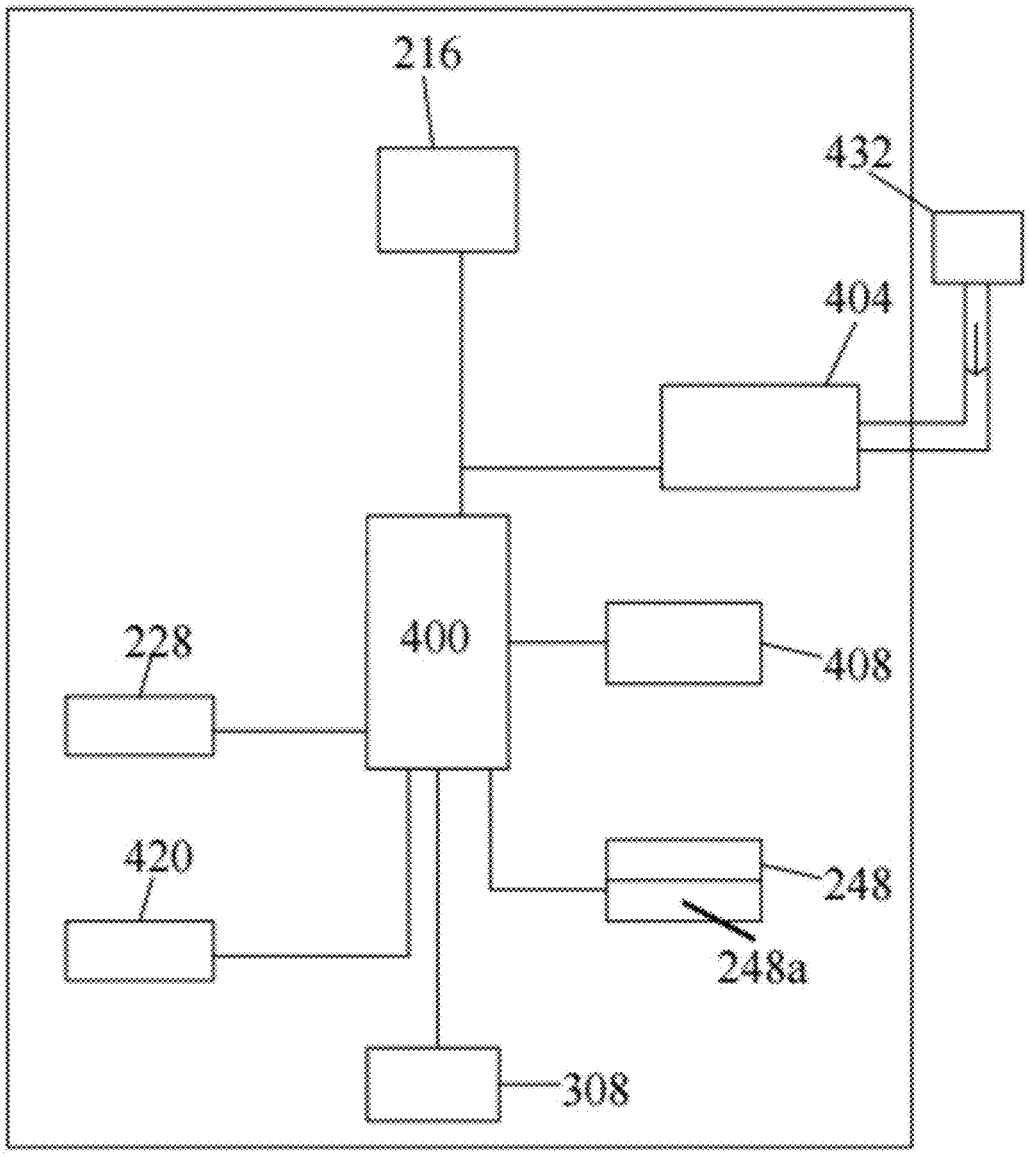
FIG. 4 shows a schematic diagram of the hand and foot washing device of FIG. 1.

Referring to FIG. 4, a schematic diagram of the hand and foot washing device 100 is described. The control unit 400 is connected and configured to operate the first spray 216, a first water storage 404, a second water storage 408, the pair of motor 248, 248*a*, a weighing scale 420, the display unit 228 and the nozzle 308. In this present embodiment, the first water storage 404 stores water however, the first water storage may store any other fluid in other embodiments of the present invention.

The nozzle 308 is connected with the first water storage 404 through the pipes (not seen) passing through the connector 108. The wash basin 312 is connected with the second storage tank 408 to drain the waste water through the pipes (not seen) passing through the connector 108. The second base 208 is connected with the second storage tank through the pipe connector 304.

The second water storage 408 stores drain water outlet from the device 100. The first water storage 404 and the second water storage 408 is connected with the device 100 through the pipe connector 304. The first water storage 404 receives fresh water from a pipe connected to a main water storage 432. The second water storage 408 drains the used water from the device 100 through the outlet pipe.

The weighing scale 420 includes a weight sensor embedded on the underside of the protective mesh 209 for measuring weight of the user. The measured weight is displayed on the display unit 228 through the control unit. The weighing scale 420 detects the presence and accordingly communicates with the control unit 400 to start a motor (not seen) and outlet water, soap and water from the first spray 216 and spray holes respectively. Accordingly, the motion sensor communicates with the control unit 400 to inlet the water through the nozzle 308.

In a preferred embodiment of the present invention, the feet washing unit 112 includes a plurality sensors positioned in the first water storage, the second water storage, the pair of belt brushes 220 and the pair of storage tanks to determine the level, temperature and purity of liquid (for e.g. soap, water, etc.). In another embodiment of the present invention, the first water storage tank include a heating coil for heating the stored water and dispensing said heated water through the first spray 212.

Now referring to FIGS. 1-4, in operation, a user who wants to wash his feet approaches the device 100 and places his feet on the pair of protective mesh 209. The control unit 400 activates the device 100. The weighing scale 420 detects the presence through PNP sensors and communicates with the control unit 400. Further. the control unit 400 communicates with the sensors in the first water storage 404 to detect the level and temperature of water present in the first water storage 404. The control unit 400 activates the motor if the amount of water is sufficient.

Further, the water is inlet through the first inlet 236, the first spray 216 and spray holes. The first spray 216 and spray holes spray water on the feet positioned on the protective mesh 209. In accordance with the present invention, the control unit activates the second inlet 240 and sprays the soap water through the spray holes. In a next step, the control unit 400 again activates first inlet 236 to spray water on the feet. After the previous step, now the scrubbing action in accordance with the present invention is initiated. Accordingly, the control unit 400 activates the third inlet 244 to inlet air on the feet. Simultaneously, the pair of motor 248, 248*a* drives the pair of chain drive 256, 256*a* thereby scrubbing the pair of belt brushes 220 against the feet of the user.

After a predefined amount of time is passed (generally 12-15 seconds), the control unit stops the motor 248, 248*a*. The dust and mud from the feet of the user are cleaned by the water, soap and air. Also, the dirt is removed by scrubbing the belt brushes 220 against the feet. The waste water collected in the second base 208 is drained through the pipe connector 304 into the second storage tank 408. If the second water storage is nearing or completely filled, the control unit 400 opens the valve in the outlet pipe connector emptying the second water storage 400. During cleaning of the feet, the weighing scale 420 of the device 100 weighs the user and the control unit 400 displays the value on the screen display 228. The plurality of indicators preferably indicate whether the device 100 is ON, functioning properly, receiving adequate water supply and has optimal levels of soap, and water, etc. however the device 100 is configurable to indicate other aspects as well.

Now when the user places his hand inside the basin 312, the sensors detect the movement and the control unit 400 dispenses soap through the nozzle 308 for a predefined amount of time (generally 2-3 seconds). After waiting for a predefined amount of time (5-7 seconds) for the user to spread the soap across his/her hand, water from the first water storage 404 is dispensed from the nozzle 308 for a predefined amount of time (30-40 seconds). The used/impure water passes through an exit pipe placed in the connector 108 to the second water storage 408. The hands and feet of the user are completely cleaned by the device 100.

In another embodiment of the present invention, the device 100 is connectable to a mobile/computer application that allows control and notifications from the device 100. In this embodiment, the weight of the user is displayable on the mobile instead of the display unit to protect privacy.

The hand and foot device 100 is advantageously light in weight and portable. The hand and foot device 100 is advantageously configurable to change the predefined time of cleaning cycle as per requirement of the user. The hand and foot device 100 is advantageously configurable to display various parameters and aspects of the device 100 on the display unit.

The embodiments were chosen and described in order to best explain the principles of the present invention and its practical application, to thereby enable others, skilled in the art to best utilize the present invention and various embodiments with various modifications as are suited to the particular use contemplated.

It is understood that various omission and substitutions of equivalents are contemplated as circumstance may suggest or render expedient, but such are intended to cover the application or implementation without departing from the scope of the present invention.

The invention claimed is:

1. A hand and foot washing device 100 having a screen display 228, a first water storage 404, a second water storage 408, a main water storage 432 characterized in that said device 100 comprising:

a hand washing unit 104 for cleaning user's hand, a connector 108 connecting the hand washing unit 104 with a feet washing unit 112, a control unit 400 configured to operate the hand washing unit 104 and the feet washing unit 112;

the hand washing unit 104 including a nozzle 308 dispensing fluid and a basin 312 collecting the dispensed water;

the feet washing unit 112 including a first base 204, a second base 208; the first base 204 including a first sprayer 216;

the second base 208 including a pair of protective mesh 209 receiving user's feet; the feet washing unit 112 including a first inlet 236, a second inlet 240, a third inlet 244, a pair of belt brushes 220, a pair of motors 248, 248*a*, a drive belt 252 and a pair of chain drives 256, 256*a;* the control unit 400 being configured for operating the pair of motors 248, 248*a* scrubbing the pair of belt brushes 220 and dispensing the water, soap and air from the nozzle 308 and the first sprayer 216 respectively; and a weighing scale 420 including a weight sensor positioned below the pair of protective mesh 209 for detecting the presence of human feet and activating the control unit 400.

2. The hand and foot washing device 100 as claimed in claim 1, wherein a pipe connector 304 receiving water from the first water storage 404 and draining the waste water to the second water storage 408.

3. The hand and foot washing device 100 as claimed in claim 1, wherein the connector 108 encapsulating pipes for inletting and out letting the water from the first water storage 404 and the second water storage 408 respectively.

4. The hand and foot washing device 100 as claimed in claim 1, wherein a motion sensor sensing the hand movement below the nozzle 308.

5. The hand and foot washing device 100 as claimed in claim 1, wherein the first sprayer 216 including nozzles for dispensing fluid on the user's feet.

6. The hand and foot washing device 100 as claimed in claim 1, wherein the pair of chain drive 256, 256*a* being fixedly connected to the pair of motor 248, 248*a*.

7. The hand and foot washing device 100 as claimed in claim 1, wherein the drive belt 252 being fixedly attached with the chain drive 256, 256*a*.

8. The hand and foot washing device 100 as claimed in claim 1, wherein the pair of belt brushes 220 being fixedly position on the drive belt 252.

9. The hand and foot washing device 100 as claimed in claim 1, wherein the pair of motor 248, 248*a* driving the chain drive 256, 256*a*, the drive belt 252 and the pair of belt brushes 220.

* * * * *